US005114360A

United States Patent [19]

Steinhardt et al.

[11] Patent Number: 5,114,360

[45] Date of Patent: May 19, 1992

[54] ELECTRICAL COUPLING DEVICE

[75] Inventors: Helmut Steinhardt, Nürnberg; Anton Bieringer, Schwabach, both of Fed. Rep. of Germany

[73] Assignee: TRW Daut & Rietz GmbH & Co. KG, Nurnberg, Fed. Rep. of Germany

[21] Appl. No.: 499,410

[22] PCT Filed: Oct. 10, 1989

[86] PCT No.: PCT/EP89/01196

§ 371 Date: Jul. 10, 1990

§ 102(e) Date: Jul. 10, 1990

[87] PCT Pub. No.: WO90/04271

PCT Pub. Date: Apr. 19, 1990

[30] Foreign Application Priority Data

Oct. 12, 1988 [DE] Fed. Rep. of Germany ..... 3834651

[51] Int. Cl.[5] ..... H01R 4/50

[52] U.S. Cl. ..... 439/341; 439/701

[58] Field of Search ..... 439/341, 350–357, 439/686, 677, 701, 680

[56] References Cited

U.S. PATENT DOCUMENTS

| | | | |
|---|---|---|---|
| 3,042,894 | 7/1962 | Fox | 439/701 X |
| 3,072,340 | 1/1963 | Dean | 439/701 X |
| 3,173,734 | 3/1965 | Hrtwell | 439/701 X |
| 3,668,605 | 6/1972 | Albert | 439/341 |
| 4,596,436 | 6/1986 | Kraemer et al. | 439/686 X |

FOREIGN PATENT DOCUMENTS

| | | |
|---|---|---|
| 251518 | 1/1988 | European Pat. Off. . |
| 7339199 | 11/1978 | Fed. Rep. of Germany . |
| 2806437 | 8/1979 | Fed. Rep. of Germany . |
| 3634695 | 4/1988 | Fed. Rep. of Germany . |
| 2098545 | 2/1972 | France . |
| 8867164 | 7/1964 | Switzerland . |
| 2219445 | 12/1989 | United Kingdom . |

*Primary Examiner*—Neil Abrams
*Assistant Examiner*—Khiem Nguyen
*Attorney, Agent, or Firm*—Collard, Roe & Galgano, P.C.

[57] ABSTRACT

Electrical coupling device with a measuring contact bank fixedly mounted on an appliance frame and a bush contact bank arranged inside a housing, where one of the front ends of the housing can be fixed on the appliance frame while its other front end can be fastened by means of a hook provided on the housing and a corresponding nose on the apparatus frame. In said electrical device, the housing (5) is provided with a frame (9) and modular bush contacts (11) are arranged in the inner part (9') of the housing.

7 Claims, 2 Drawing Sheets

ELECTRICAL COUPLING DEVICE

Figure 1:
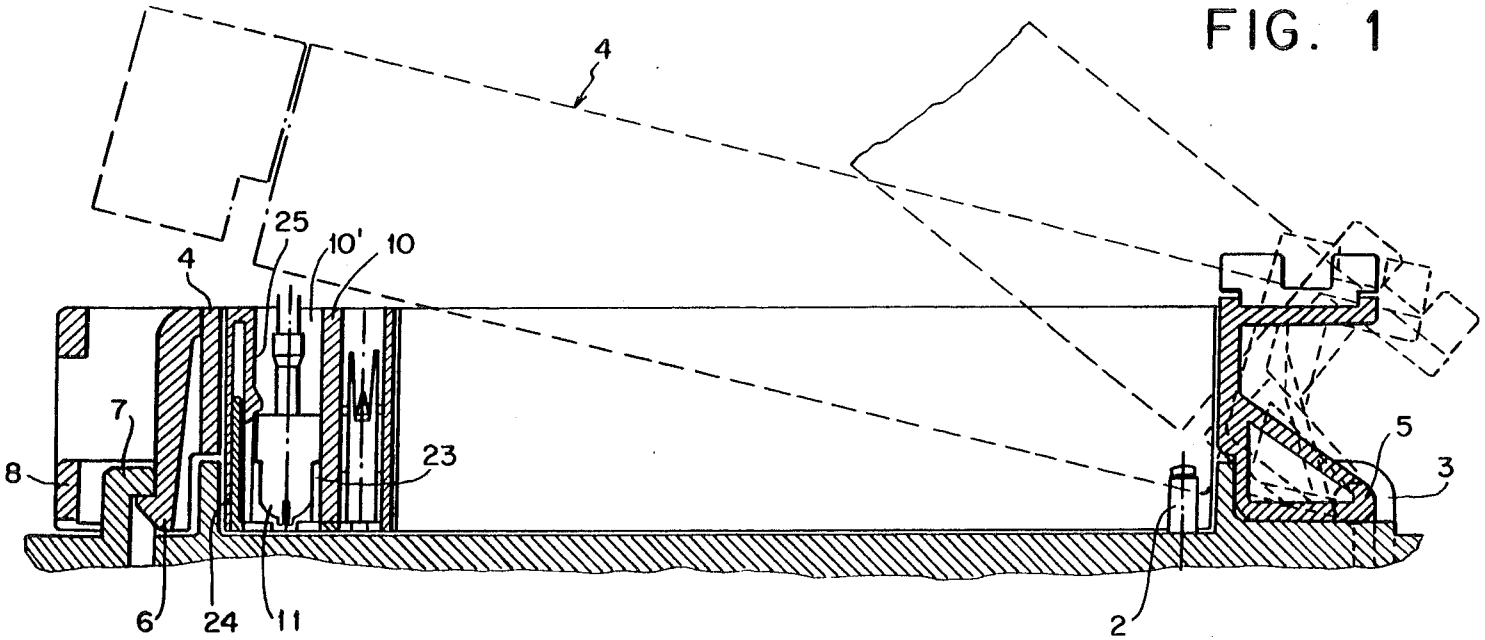

The invention relates to an electrical coupling device with a blade contact strip fixed to an equipment frame and a socket contact strip contained in a housing, in which the housing can be mounted on pivot pins on the equipment frame at a frontal end, and at the other frontal end, a hook arranged on the housing and a projection assigned to it on the equipment frame can be locked together to attach it.

In known coupling devices of this type, a one-piece socket contact strip with a large number of pre-determined socket elements is arranged in a housing, and it can be coupled with the blade contacts of the equipment frame by pivoting the housing against the equipment frame. It is a disadvantage in these devices that for coupling procedures with a different number of socket contacts, socket contact strips with different components always have to be inserted into the housing, which requires a large expenditure for material and inventory. In addition, a replacement of socket contact strips is, in total, difficult and time-consuming.

It is the task of the invention to create measures for socket contact strips that can be equipped and changed as desired.

According to the invention, it is provided for this purpose that the housing has a frame and that socket contacts set in modular fashion are arranged in the interior of the frame. In this manner, it is possible to set up socket contact strips with a predetermined structure, in the form of a modular system, by inserting modules equipped with a desired number of socket elements and arranging them in the housing. The frame, which remains the same, can hold modules with different components and of varying length, and thereby form socket contact strips with the number of socket contacts corresponding to the requirements in question. Thus it is also possible to use empty modules, between or along with modules with socket contacts arranged in them.

In a version of the coupling device, it is provided that the modules which hold the socket contacts have supporting strips on the end facing away from the blade contacts, which strips can be supported on the longitudinal frame sections, and recesses with contact areas for supporting elements arranged on the longitudinal frame sections at the distance of the supporting strips. In this way, insertion of the modules requires simple plug-in steps, until the supporting strips come up against the longitudinal frame sections, and when the working position of the modules in the frame has been reached, automatic fixation of the modules can also be achieved. Preferably, the supporting elements are formed by projections or molded pieces arranged on the inside of the strip sections cut to be part of the longitudinal frame sections. The strip sections give the advantage that during plug-in steps of the modules, the projections or molded pieces are first automatically moved outward by the module housings, against material stress, and then automatically snap back when the working position of the modules has been reached, over the contact areas. Preferably, the supporting elements are structured at pre-determined distances along the longitudinal frame sections, with the distance of the supporting elements from one another following a grid dimension, especially a variable one.

In a further version of the coupling device, it is provided that the longitudinal frame sections are provided with coding elements on the inside, which mesh with coding recesses of the modules. The coding components present the insertion of incorrect modules into the frame. The coding elements can be formed by strips which extend in the insertion direction of the modules and the recesses of the modules can be formed by corresponding grooves formed in the module housings.

Finally, it is also provided to provide at least one groove/spring arrangement for the modules in the common separation surfaces. The groove/spring arrangement results in an alignment of the modules relative to one another, in the longitudinal direction of the housing. In addition, the groove/spring arrangement prevents lateral movement of the modules relative to one another and relative to the frame sections, which is undesirable for precise coupling.

In order to obtain frames resistant to bending for coupling devices with housings of greater length, it is provided that the longitudinal frame sections are rigidly connected with one another by at least one cross-stay. The cross-stays can have at least one spring with the same cross-section as the grooves of the modules on one side, and at least one groove with the same cross-section as the springs of the modules on the other side. It is understood that for socket contact housings with a great width, two or more springs and grooves can be arranged on the cross-stays.

Furthermore, it is also provided to provide the modules with a number of prepared core openings which can be equipped with socket contacts, into which the socket contacts can be supported on the module housing and can be locked in place with clamping elements. Slides which can be brought into the core opening can serves as clamping elements, with these slides locking the socket contacts in place directly, or allowing fixation of the socket contacts in the core openings via a wall section which can be bent away and is fixed to the module housing.

In order to simplify removal of the socket contact housing from the equipment frame, the invention also provides that the hook which holds the housing to the equipment frame has a fixed eye which serves as the activation element for the hook, and that by pivoting the eye away, the hook can be pivoted freely away from the projection which is fixed to the equipment frame. The eye results in a lever effect, which makes free movement of the hook possible with little expenditure of force.

Figure 2:
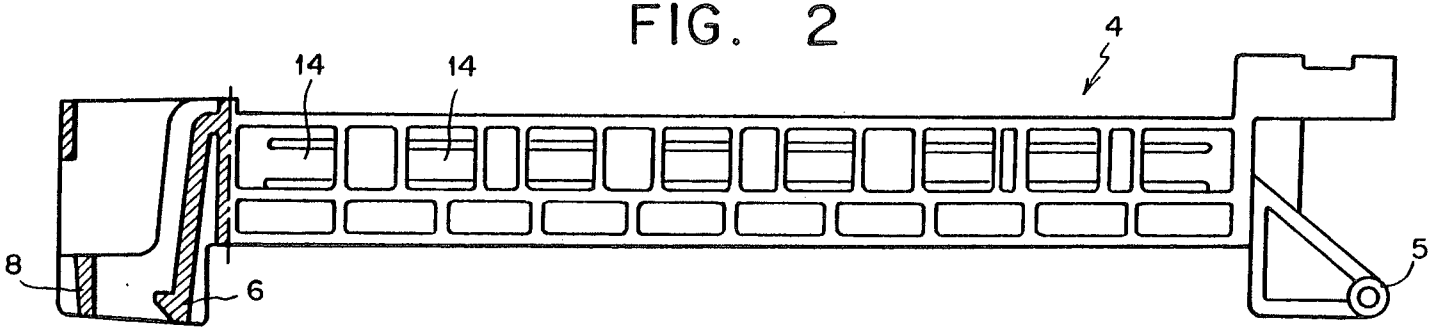
Figure 3:
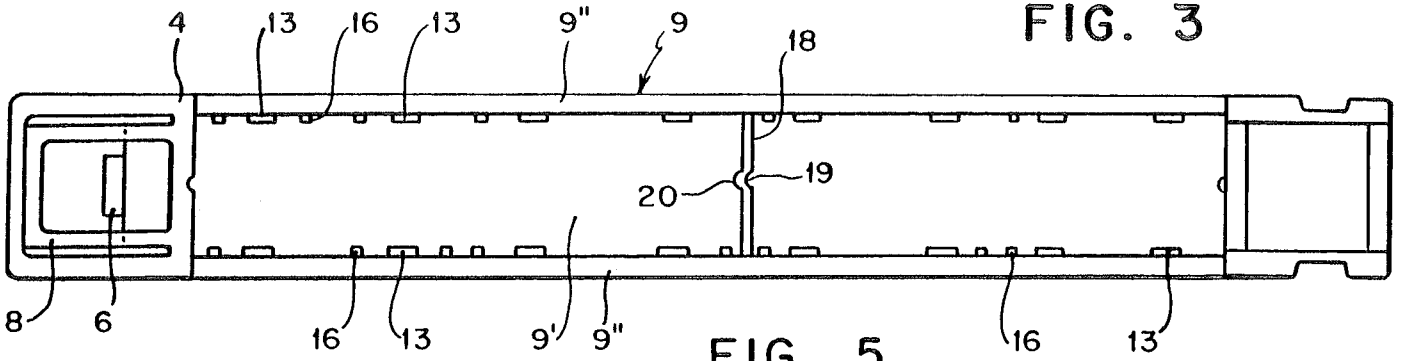
Figure 5:
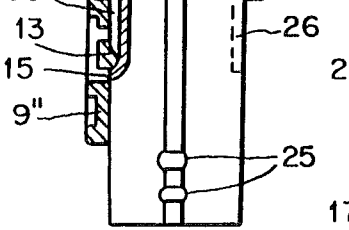
Figure 6:
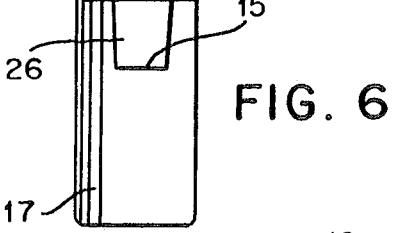
Figure 4:
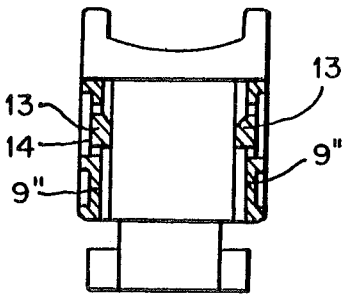
Figure 8:
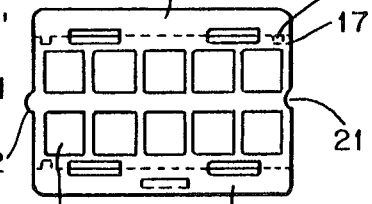
Figure 7:
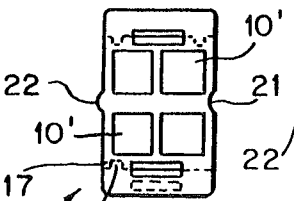

The invention is explained in the drawings, on the basis of an embodiment. The figures show:

FIG.1: a coupling device in cross-section,

FIG.2: a socket contact housing in a side view, partially in cross-section,

FIG.3: a socket contact housing in a top view,

FIG.4: a cross-section along the line IV—IV of FIG. 3,

FIG.5: a module for holding socket contacts in a front view, partially in cross-section,

FIG.6: a module according to FIG.5 in a side view,

FIG.7: a module according to FIG.5 in a top view,

FIG.8: a module of a different version in a top view, and

Figure 9:
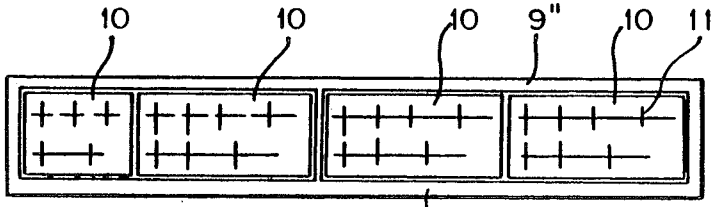

FIG.9: a block system with modules for a socket contact strip.

In the figures, 1 indicates an equipment frame, which holds a blade contact strip not shown in greater detail. One blade contact 2 of the blade contact strip is shown. The equipment frame 1 has eyes 3, into which a housing 4 can be mounted to pivot, by means of pivot pins 5. The housing 4 serves to hold socket contacts and can be locked in place on the equipment frame 1, at the end facing away from the pivot pins, by means of a hook 6. For this purpose, the hook 6 locks in place behind a projection 7, which is rigidly attached to the equipment frame. The hook 6 has a rigidly attached eye 8, which allows pivoting movement of the hook 6 in a counterclockwise direction, to release it, when the eye is pressed upward. There is also the other possibility of arranging the hook 6 on the equipment frame 1 and the projection 7 on the housing 4.

As FIG. 3, in particular, shows, the housing 4 has a frame 9. In the interior 9' of the frame 9, a number of pre-determined modules 10 (FIG. 5-8) with socket contacts 11 arranged in core openings 10' can be inserted, corresponding a modular system (FIG. 9). The modules 10 can be put into place in the interior 9' from the top, until they come to rest against supporting strips 12 which are rigidly attached to the module, and are fixed in place when they reach this working position, by means of supporting elements 13. The supporting elements 13 are arranged on cut strip sections 14 of the longitudinal frame sections 9", and cover contact areas 15 on the modules 10, provided in the area of recesses 26. By means of the supporting strips 12 and the supporting elements 13, the modules 10 are held firmly in place in the frame 9. The longitudinal frame sections 9" have coding strips 16, which can be brought to cause their effect with recesses 17 in the housings of the modules 10. Corresponding to the structure of the coding strips 16 and recesses 17, incorrect insertion of the modules 10 is precluded. The socket contacts 11 rest against supporting surfaces 23 in the core openings 10', and are fixed in place in the modules 10 by wall sections 25 which can be pivoted away by means of slides 24. The slides 24 can lock into recesses 26 of the module housing.

It is understood that any desired number of modules 10 with any desired structure, including blank modules, can be placed in the frame, resulting in the socket contact strip in combination with one another. The longitudinal frame sections 9" are rigidly connected with one another by a cross-stay 18, preventing undesirable twisting of the longitudinal frame sections 9" or bending of these, which are a cause of insecure or inaccurate hold of the modules 10. The stay 18 has at least one groove 19 on one side and at least one spring 20 on the opposite side, which can be brought to cause their effect with corresponding grooves 21 and spring 22 on the modules 10. The springs 22 and grooves 21 of the modules 10 allow their axial alignment relative to one another and relative to the frame sections 9".

We claim:

1. Electrical coupling device comprising:

an equipment frame having a first end and a second end, said equipment frame having a projection;

a blade contact strip fixed to said equipment frame;

a housing having a hook;

a socket contact strip contained in said housing;

said housing being mounted on pivot pins on the equipment frame at the first end, and at the second end of the frame, said hook being arranged on the housing and said projection aligned with said hook so that the equipment frame can be locked together to said housing;

said housing having a frame;

modules held by said frame, said modules having socket contacts capable of being plugged into said frame;

said frame having longitudinal frame sections equipped on the inside with strips which extend in the insertion direction of the modules;

said strips being used as coding elements, and said frame having cut strip sections having molded piece projections being supporting elements for said modules; and said modules having supporting strips, and said supporting elements forming abutments for said supporting strips arranged on said modules.

2. Coupling device according to claim 1, wherein said equipment frame has a blade contact at the first end and said modules have supporting strips on the end facing away from the blade contact; and said modules have recesses with contact areas for said supporting elements at a distance from said supporting strips.

3. Coupling device according to claim 1, wherein the supporting elements are arranged on the longitudinal frame sections in a grid arrangement.

4. Coupling device according to claim 1, further comprising said modules having at least one groove/spring arrangement in the common separation surfaces of adjacent modules.

5. Coupling device according to claim 1, further comprising at least one cross-stay;

said longitudinal frame sections being rigidly connected with one another by said at least one cross-stay;

said cross-stay having at least one spring with the same cross-section as the grooves of the modules on one side, and at least one grove with the same cross-section as the springs of the modules on the other side.

6. Coupling device according to claim 1, wherein said module having a supporting surface and a wall recess made movable by a slider; and said modules have a number of prepared core openings equipped with socket contacts; and said socket contacts being locked in place in said core openings between said supporting surface and said wall recesses made movable by said slider.

7. Coupling device according to claim 1, wherein said hook holds the housing to the equipment frame having a fixed eye which is the activation element for said hook and that by pivoting the eye away, said hook can be pivoted freely away from the projection which is fixed to the equipment frame.

* * * * *